US007954664B2

(12) United States Patent
Cronin et al.

(10) Patent No.: US 7,954,664 B2
(45) Date of Patent: Jun. 7, 2011

(54) PUSH AND FLIP CONTAINER

(75) Inventors: Edward P. Cronin, Brodhead, WI (US); George Solowiejko, Rockford, IL (US)

(73) Assignee: J.L. Clark, Inc., Rockford, IL (US)

( * ) Notice: Subject to any disclaimer, the term of this patent is extended or adjusted under 35 U.S.C. 154(b) by 997 days.

(21) Appl. No.: 11/762,469

(22) Filed: Jun. 13, 2007

(65) Prior Publication Data

US 2008/0308569 A1 Dec. 18, 2008

(51) Int. Cl.
*B65D 43/16* (2006.01)
*B65D 43/22* (2006.01)
*B65D 51/18* (2006.01)

(52) U.S. Cl. ..... 220/819; 220/282; 220/283; 220/826; 220/835; 220/840

(58) Field of Classification Search ..... 220/254.3, 220/259.2, 819, 817, 826, 835, 840, 282, 220/283
See application file for complete search history.

(56) References Cited

U.S. PATENT DOCUMENTS 4,371,095 A * 2/1983 Montgomery et al. .. 222/153.14
4,607,768 A * 8/1986 Taber et al. ..... 222/556
4,901,892 A * 2/1990 Song ..... 222/498
5,190,152 A * 3/1993 Smith et al. ..... 206/425
5,273,177 A * 12/1993 Campbell ..... 220/281
5,549,214 A * 8/1996 Harris ..... 220/819
D407,976 S * 4/1999 Ekkert ..... D9/449
5,927,535 A * 7/1999 Goth ..... 220/254.3
6,129,237 A * 10/2000 Miyahara ..... 220/812
D448,296 S 9/2001 Bried et al.
D448,668 S 10/2001 Baerenwald et al.
D464,567 S 10/2002 Baerenwald et al.
D464,886 S 10/2002 Bried et al.
D466,408 S 12/2002 Baerenwald et al.
D467,801 S 12/2002 Baerenwald et al.
D474,402 S 5/2003 Baerenwald
6,732,873 B2 5/2004 Bried et al.
6,742,666 B1 * 6/2004 Bried et al. ..... 215/235
D513,584 S 1/2006 Solowiejko et al.
2007/0175909 A1 * 8/2007 Solowiejko ..... 220/826

* cited by examiner

*Primary Examiner* — Anthony Stashick
*Assistant Examiner* — Niki M Eloshway
(74) *Attorney, Agent, or Firm* — Reinhart Boerner Van Deuren P.C.

(57) ABSTRACT

A push and flip lid for a container is provided. The lid includes a lid body, an opening, a door, and first and second pivot supports. The lid body has a top and a skirt. The skirt depends downwardly from the top and extends around a periphery of the top. The opening is formed through the lid body. The door is arranged over the opening and connected to the lid body. The door has a push section and a flip section connected by a hinge. First and second pivot supports on the lid body are separated by the opening. The opening extends between the first and second pivot supports and engages the door at first and second discrete locations, respectively. As such, the flip section pivots about the hinge in response to downward pressure applied to the push section to uncover the opening.

7 Claims, 7 Drawing Sheets

PUSH AND FLIP CONTAINER

FIELD OF THE INVENTION

This invention generally relates to containers and, more particularly, to containers and/or lids with push and flip type doors.

BACKGROUND OF THE INVENTION

Containers employ lids of all shapes and sizes with various dispensing structures. For example, a hole or an array of holes is often provided in the lid for dispensing the contents of the container. A door is operable to cover and reveal these dispensing holes. As disclosed in U.S. Pat. Nos. 6,742,666 and 6,732,873, one type of door is a double hinged door. Such a door typically comprises two different sections hinged together. One of these door sections is hinged to the lid. The structure of the lid beneath the door is designed such that pressing downwardly on the door section hinged to the lid causes the other door section to flip upwardly revealing the hole or other dispensing structure. The present invention is directed toward improvements over the state of the art.

BRIEF SUMMARY OF THE INVENTION

A push and flip container that has a dispensing opening occupying a substantial portion of a lid top is provided. As such, a larger storage area can be provided within the container for a given size of containment vessel with increased product storage volume. Although not limited thereto, this can be particularly useful for small hand held applications where a reduction in bulkiness (e.g., for pockets) is beneficial and/or alternatively an increased storage capacity is provided so that one can carry around more product. In addition, the contents within the container may be more accessible and accessible to varying degrees as needed depending on how the container is used. Also, because the dispensing opening occupies more of the lid body, less material can be used to form the container. Because less material is needed, the container may generally be more cost effectively made.

One aspect of the present disclosure is directed toward a lid that may be used in connection with a container to provide a containment vessel. The lid includes a lid body having a lid top and a skirt depending downwardly from the lid top and extending around a periphery of the lid top. An opening is formed through the lid body. The door is arranged over the opening and connected to the lid body. The door has a push section and a flip section connected by a hinge. First and second pivot supports on the lid body are separated by the opening. The opening extends between the first and second pivot supports and engages the door at first and second discrete locations, respectively. As such, the flip section pivots about the hinge in response to downward pressure applied to the push section to uncover the opening.

Another aspect of the present disclosure is directed toward a containment vessel, which may be provided by a lid and a container. The containment vessel includes a body defining a base, a top and a sidewall extending transversely between the base and top to define an enclosed space. An opening is formed through the body and provides access to the enclosed space. A door is attached to the body and covers the opening. The door has a push section and a flip section that are connected by a hinge. The first and second pivot supports are formed on the body in lateral spaced relation. The first and second pivot supports engage the door at first and second discrete locations, respectively. As such, the flip section pivots about the hinge in response to downward pressure applied to the push section to uncover the opening. The enclosed space extends between the first and second supports such that the enclosed space is in direct communication with both the push and flip sections of the door through the opening.

According to a more specific embodiment disclosed here, the lid for a container includes a lid body, a front shelf, rear shelves, first and second pivot walls, a door, and detent structures. The lid body has an aperture passing therethrough. The front shelf extends inwardly into the aperture and progresses along a front wall and a front portion of side walls of the lid body. The rear shelves extend inwardly into the aperture and progress along a rear portion of the side walls of the lid body. The first and second pivot walls couple the front shelf to the rear shelves, extend inwardly into the aperture, and are generally transverse to the front shelf. The door is pivotally coupled to the lid body proximate the rear shelves and has a push section pivotally connected to a flip section. The flip section engages the first and second pivot walls and pivots away from the aperture in response to a downward pressure on the push section. The detent structures are formed on the lid body proximate the pivot walls and the rear shelves. The detent structures hold the push section at a first position when the flip section covers a forward portion of the aperture and at a second position when the flip section is pivoted away from the forward portion of the aperture due to application of the downward pressure.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
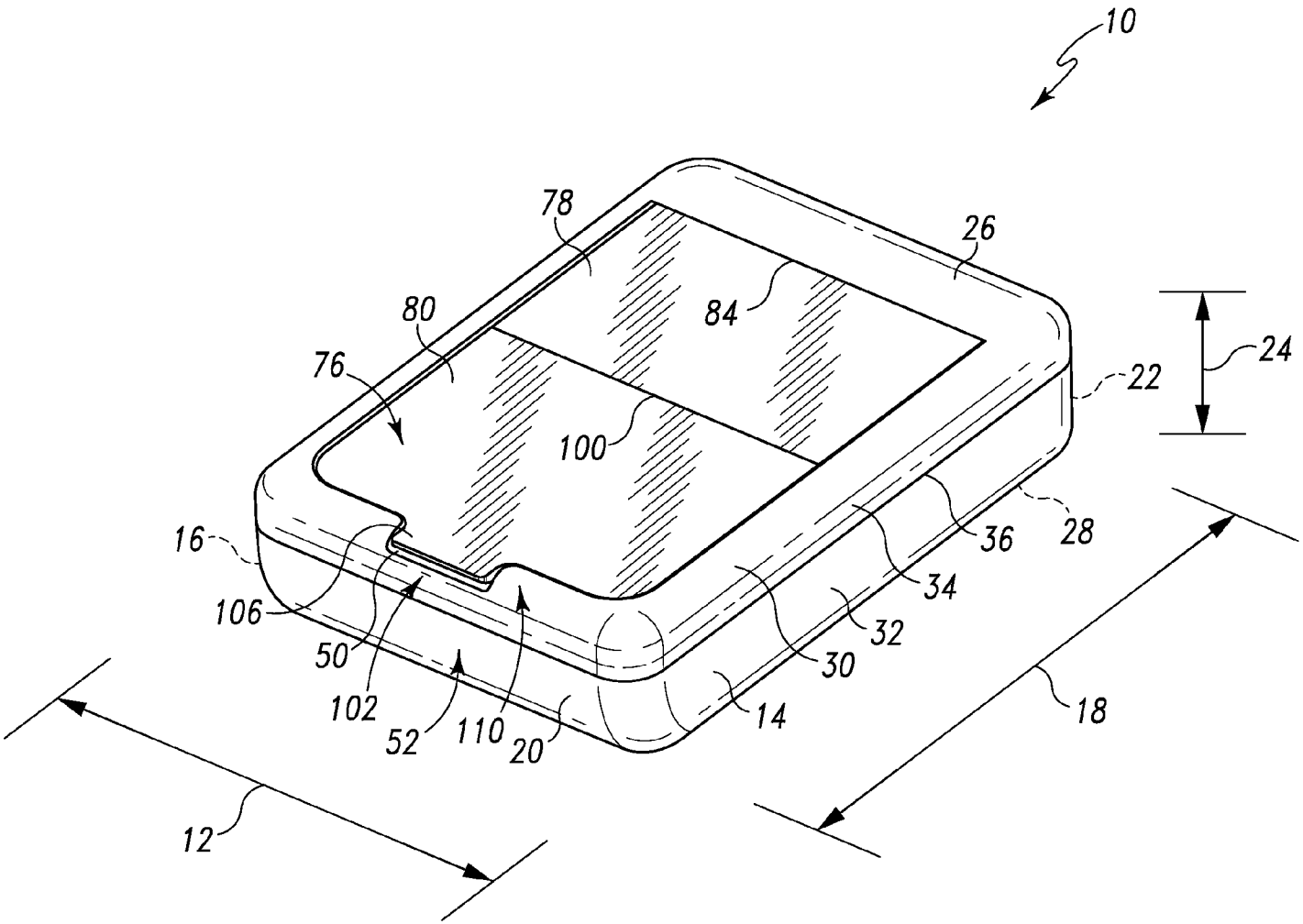
FIG. 1 is a front and top exemplary embodiment of a push and flip container in accordance with the teachings of the present invention.

Referring to FIG. 1, a containment vessel 10 is illustrated. The containment vessel 10 can be readily and most easily provided by a separately molded plastic lid 30 and a container 32 parts which are then snapped together. The lid 30 and container 32 may also be molded as one part, in which the lid 30 and the container 32 would be unitarily connected by a foldover hinge.

The containment vessel 10 shown in the disclosed embodiment is particularly useful for handheld applications and may be readily stored and retrieved from one's pocket. Typically applications my include confections, or such things as tobacco or other small consumer items. To provide for handheld type applications, the overall containment vessel 10 generally has: (a) a width 12, which in this embodiment is measured from one side 14 to another 16, of between about 1½ to about 2½ inches, (b) a length 18, which in this embodiment is measured from a front 20 to a back 22, of between about 2½ to about 3½ inches, and a height 24, which is measured from a top 26 to a bottom 28, of between about ¼ of an inch to about 1 inch. It will be recognized that the length and width could also be reversed in which the width would be between front and back and the length between opposing sides.

As illustrated, the containment vessel 10 and particularly at least the lid 30 are preferably constructed of a suitable plastic material that provides some resiliency. However, other materials may also suitably be used to form the containment vessel 10 such as, for example, metal. For example, the container 32 of the vessel 10 may be made of metal. Depending on the desired use and whether the contents, or lack of contents, within the containment vessel 10 are to be externally viewable, the vessel 10 may be transparent, translucent, or opaque. In addition, the containment vessel 10 can also be colored, carry images or prints, labels, and the like to make the container more aesthetically pleasing.

Referring in greater detail to the lid 30 (shown by itself in FIG. 5), the lid 30 has a top wall that forms the top 26 and includes a skirt 34 depending downwardly from the top 26 and extending around its periphery 36. In several places where the skirt 34 and the top 26 intersect, the lid 30 is rounded or radiused. As depicted in FIG. 1, portions of the container 32 are also rounded or radiused. As such, the containment vessel 10 may be comfortably held within a hand or by a thumb and fingers.

Figure 2:
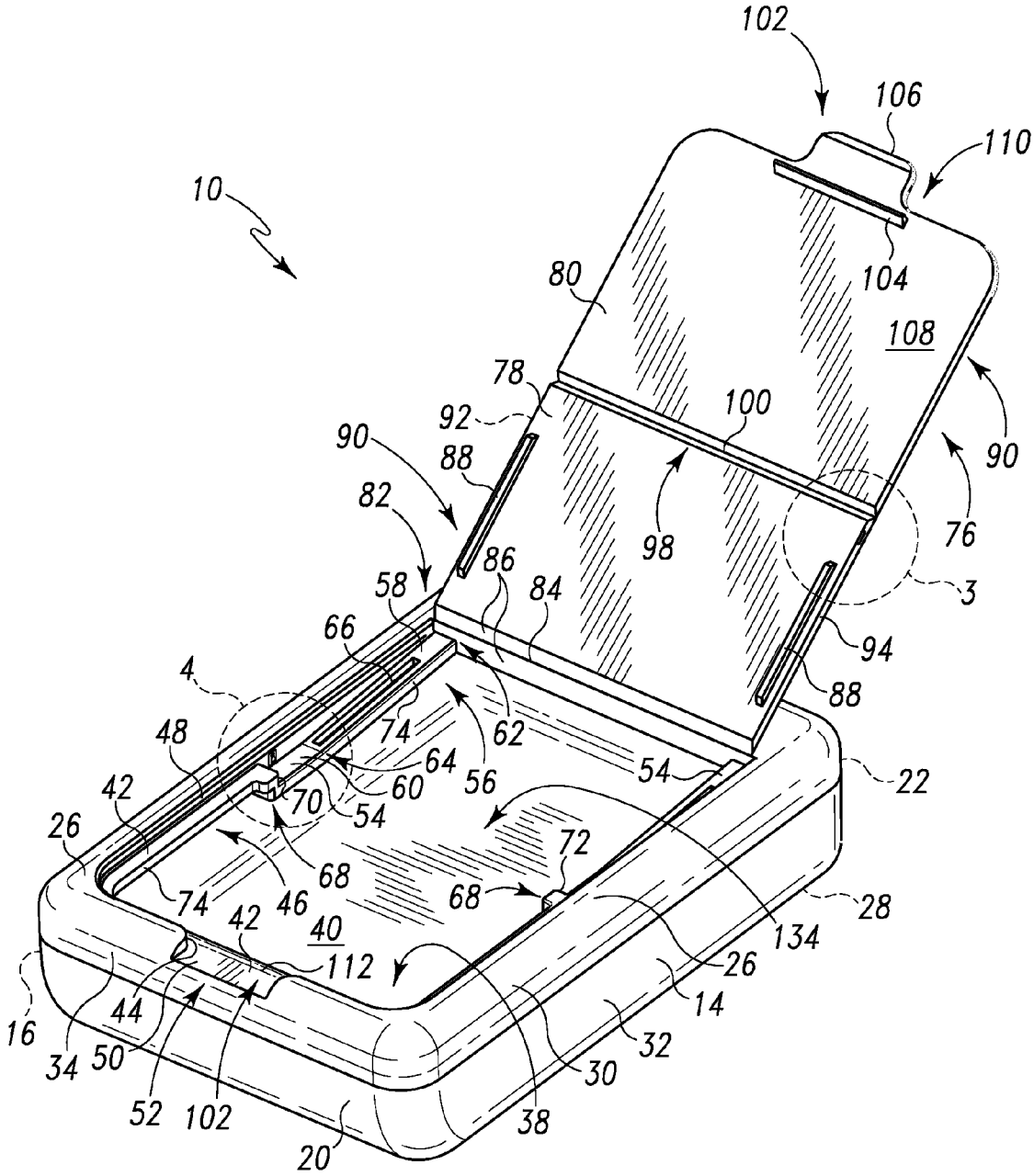
FIG. 2 is a front and top perspective view of the container of FIG. 1 in a fully opened position.

Referring now to FIG. 2, the lid 30 has a dispensing opening 38 (a.k.a., an aperture) passing therethrough such that the top 30 may appear as a generally rectangular frame or border. The dispensing opening 38 extends from proximate the front 20 of the containment vessel 10 to the back 22 and from proximate one side 14 of the container to the other 16. Therefore, the dispensing opening 38 occupies a substantial portion of a top 26 of the lid 30.

The dispensing opening 38 permits access to an inner storage area 40 (or cavity) within the containment vessel 10 and the contents held therein. The contents may include, as alluded to above, for example, mints, candies, gum, tobacco products, and the like. When the containment vessel 10 is opened and the inner storage area 40 is exposed, as will be more fully explained below, the contents may be removed from the inner storage area 40 through the dispensing opening 38 in various quantities and/or amounts as desired.

Still referring to FIG. 2, the lid 30 also includes a front shelf 42 located proximate the front 20 of the lid 30. The front shelf 42 extends inwardly into the dispensing opening 38 and progresses along a front wall 44 and a front portion 46 of side walls 48 on the lid 30. In other words, the front shelf 42 runs along three sides of the dispensing opening 38, thus having three different corresponding sections including a front section and two side sections.

As shown, the front shelf 42 is vertically displaced below the top 26 of the lid 30. The front shelf 42 is also generally planar and parallel to the top 26, which is generally planar near the side walls 48. In the illustrated embodiment, the front shelf 42 proximate the front 20 of the containment vessel 10 extends through the lid 30 to form a tab channel 50. As such, a front central portion 52 of the top 26 is recessed slightly.

Located generally behind the front shelf 42, the lid 30 includes rear shelves 54 that extend from the front shelf 42 toward the back 22 of the lid 30. The rear shelves 54 extend inwardly into the dispensing opening 38 and progress along a rear portion 56 of the side walls 48 of the lid 30. Therefore, as shown in FIG. 2, the rear shelves 54 are on opposing sides of the dispensing opening 38. The rear shelves 54 are vertically displaced below the top 26 of the lid 30 and are divided into an sloped portion 58 and a flat portion 60.

The sloped portion 58 has a highest point 62 proximate the back 22 of the containment vessel 10 and a lowest point 64 where the angle portion and the flat portion 60 intersect. Therefore, the sloped portion 58 vertically falls toward the bottom 28 of the containment vessel 10 as the sloped portion progresses from the back 22 of the containment vessel 10 to the front 20. As shown in FIG. 2, the sloped portion 58 of the rear shelves 54 is generally larger than the flat portion 60. Even so, the sloped portion 58 and the flat portion 60 may be of approximately equal size or the flat portion 60 may be the larger of the two.

In the illustrated embodiment, each of the rear shelves 54 includes a stabilizing groove 66. These stabilizing grooves 66 are generally formed in the sloped portion 58 of the rear shelves 54 and run parallel to the side walls 48 and the sides 14, 16 of the containment vessel 10. While the stabilizing grooves 66 are elongate channels situated on the rear shelves 54 generally about equally between the side walls 48 and where the dispensing opening 38 begins, the stabilizing grooves may be formed in other locations and in other orientations. Also, while the length of the stabilizing grooves 66 may vary, they generally extend over a substantial portion of the rear shelves 54.

Where the front shelf 42 and the rear shelves 54 are coupled together or intersect, the lid 30 further includes pivoting structures 68. In the illustrated embodiment of FIG. 2, the pivoting structures 68 are pivot walls 70, 72. The pivot walls 70, 72 are adjacent opposing side walls 48 of the lid 30 and are, therefore, separated from each other by the dispensing opening 38.

As shown, the upright pivot walls 70, 72 are generally transverse to the front shelf 42 and the flat portion 60 of the rear shelves 54. In other words, the pivot walls 70, 72 extend vertically between the front and rear shelves 42, 54. The pivot walls 70, 72 extend inwardly into the dispensing opening 38 from the side walls 48. In the illustrated embodiment of FIG. 2, each of the front shelf 42, the rear shelves 54, and the pivot walls 70, 72 extend about equally into the dispensing opening 38 such that the periphery 74 of the dispensing opening 38 proximate the side walls 48 of the lid 30 is linear.

Still referring to FIG. 2, a generally rectangular door 76 is shown. The door 76 includes a push section 78 and a flip section 80. One end 82 of the push section 78 is pivotally coupled to the lid 30 by a hinge 84. The hinge 84 is generally disposed on the lid 30 between the back 22 of the containment vessel 10 and the rear shelves 54. In the illustrated embodiment, the push section 78 is pivotally coupled to the lid 30 by a living hinge. Even so, other hinge mechanisms and assemblies may be suitably employed to couple the door 76 and the lid 30 together.

In some cases, the hinge 84 may be configured such that the door 76 is biased somewhat upwardly and away from the dispensing opening. In the illustrated embodiment of FIG. 2, the hinge 84 includes or is flanked by wedge surfaces 86 that, when compressed or engaged, attempt to push the door 76 away from the dispensing opening 38.

As depicted, the door 76 is generally sized and dimensioned to cover the entire dispensing opening 38. The door 76 also extends over the front and rear shelves 42, 54. Also, the dispensing opening 38 progresses all the way back to the door 76 and/or the hinge 84 coupling the door to the lid 30.

The push section 78 of the door 76 includes stabilizing ribs 88 proximate sides 90 of the door. The stabilizing ribs 88 are arranged on the push section 78 such that, in particular circumstances explained below, the stabilizing ribs will engage with the stabilizing grooves 66 formed in the rear shelves 54. In that regard, the stabilizing ribs 88 correspond in size and dimension to the stabilizing grooves 66.

In the illustrated embodiment, the stabilizing ribs 88 are generally elongate protuberances that run parallel to the side walls 48 and skirt 34 of the lid 30 and transverse to the front 20 and back 22 of the containment vessel 10. To allow the stabilizing ribs 88 to translate back and forth within the stabilizing grooves 66 when these structures are engaged, the stabilizing ribs can be somewhat shorter or somewhat smaller than the stabilizing grooves.

Figure 3:
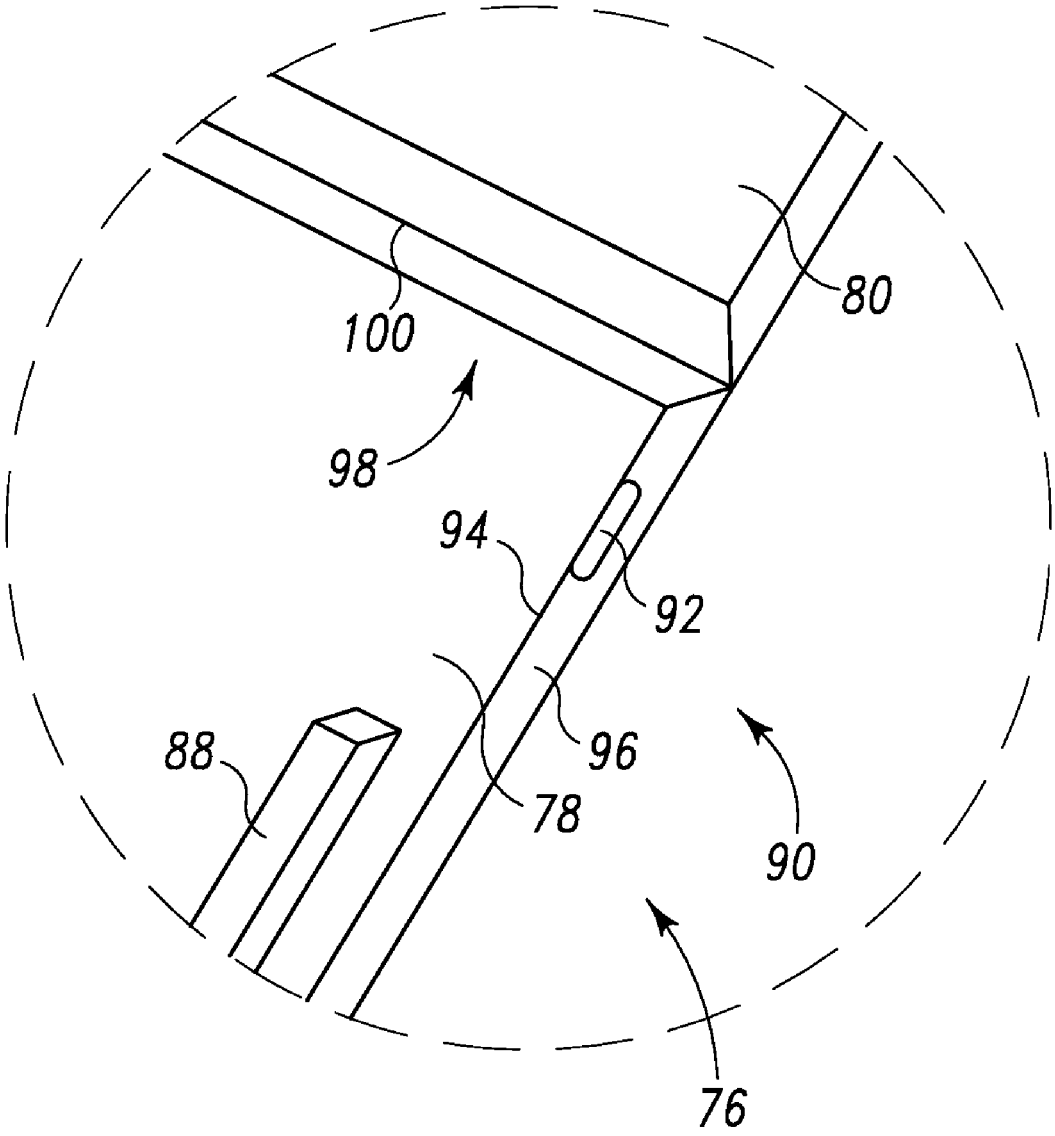
FIG. 3 is a cut away portion of the container of FIG. 2 highlighting a positioning detent.

As highlighted in FIG. 3, the push section 78 also includes positioning detents 92 that extend outwardly away from edges 94 of the push section. The positioning detents 92 are disposed proximate an outward end 96 of the push section and away from the hinge 84 coupling the door 76 to the lid 30. The positioning detents 92 are employed to maintain the door 76 in one of several discrete positions, as will be more fully explained below.

Referring back to FIG. 2, one end 98 of the push section 78 is pivotally coupled to the flip section 80. As such, the flip section 80 is generally forward of the push section 78. The push section 78 and the flip section 80 are pivotally coupled together by a hinge 100. In the illustrated embodiment, the hinge 100 is an integrally molded living hinge formed by a thin web of plastic material. Because they are coupled together in this manner, the flip section 80 and the push section 78 are able to pivot relative to one another. In that regard, the flip section 80 and the push section 78 can at times be, for example, coplanar, generally transverse to each other, or otherwise oriented relative to one other.

In addition, the flip section 80 and the lid 30 cooperate to form a catch assembly 102. In the illustrated embodiment, the catch assembly 102 comprises a catch 104, a portion of the front shelf 42, a tab 106, and the tab channel 50. The catch 104 extends away from a lower surface 108 of the flip section 80. The tab 106 projects outwardly from a forward end 110 of the flip section 80 and is generally coplanar with the flip section. Therefore, the tab 106 and the catch 104 are generally transverse to each other.

The catch 104 is arranged on the flip section 80 to engage with front shelf 42 proximate the tab channel 50. In particular, the catch 104 resiliently deforms to slide behind the front shelf 42 and forcibly engage with the front shelf 42. To promote this engagement, the front shelf 42 near the tab channel 50 is rounded or radiused inwardly toward the dispensing opening 38 to provide a guide surface 112. The guide surface 112 ensures that the catch 104 will slide inwardly toward the dispensing opening 38, and not outwardly through the tab channel 50, when the catch 104 impinges upon the front shelf 42. When the catch 104 is engaged with the front shelf 42, friction is formed between the engaged components and keeps the door 76 releasably secured to the lid 30.

When the catch 104 strikes the front shelf 42, the tab 106 simultaneously falls down into and is received by the tab channel 50. In other words, the tab 106 is seated within the tab channel 50. The tab 106 may be slightly larger than the tab channel 50 such that the tab must be forcibly biased into the tab channel 50. In such a case, friction is formed between the engaged components and also keeps the door 76 releasably secured to the lid 30. Alternatively, the tab 106 may be smaller than the tab channel 50 and simply act as a guide for coupling.

Despite the use of the catch assembly 102 in the illustrated embodiment of FIG. 2, other well known types of catch assemblies may also be suitably used to secure the door 76 to the lid 30. For example, cooperating flanges and grooves, indents and projections, and the like may be employed.

Figure 4:
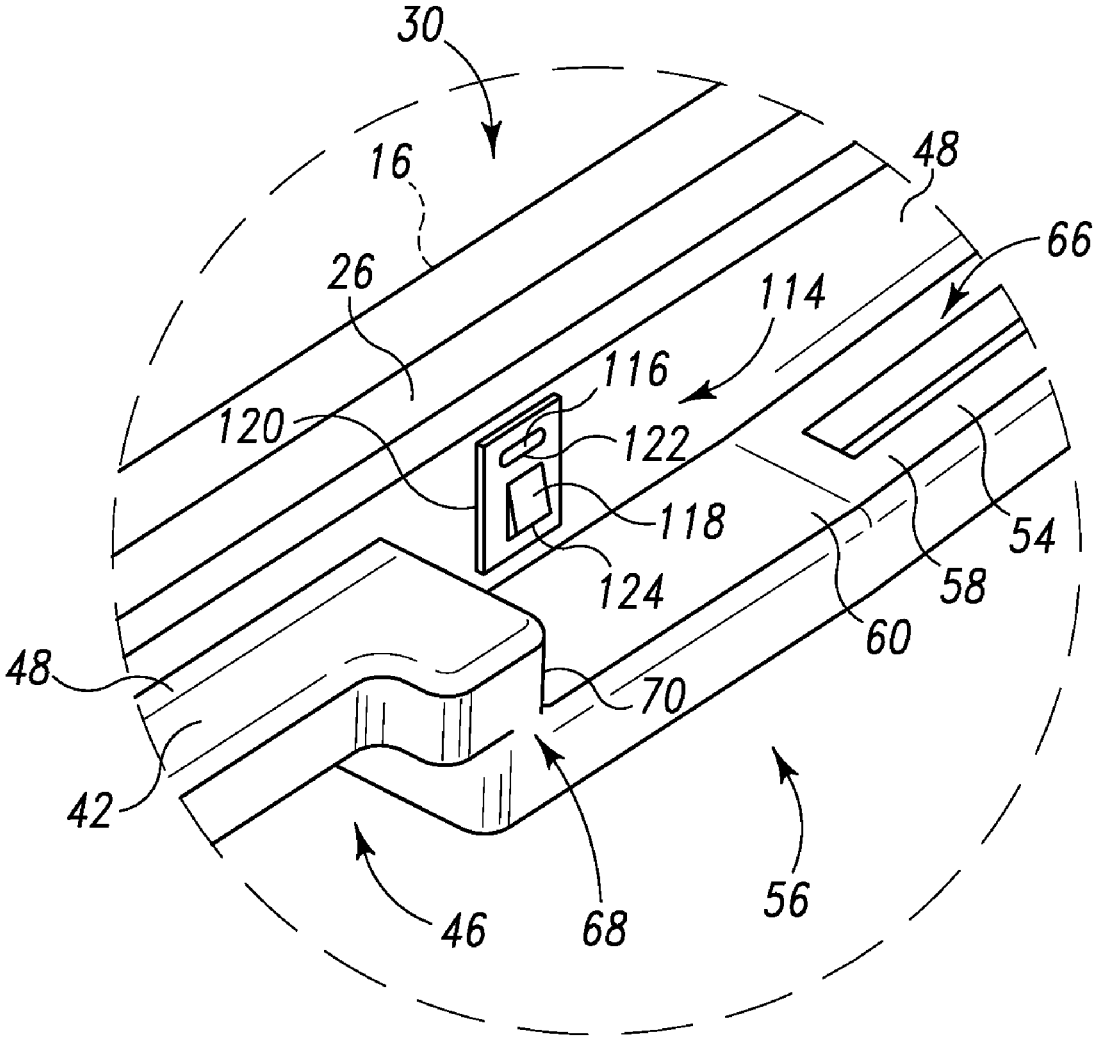
FIG. 4 is a cut away portion of the container of FIG. 2 highlighting a detent structure.

As highlighted in FIG. 4, on each of the side walls 48 of the lid 30, generally between the sloped portion 58 of the rear shelves 54 and the pivot walls 70, 72, a detent structure 114 is formed. As will be more fully explained below, these detent structures 114 are used to hold the door 76 in one of two or more discrete positions.

To perform the positioning function, each of the detent structures 114 includes a fixed detent 116 and an angled detent 118, each of which projects outwardly from a detent structure base 120 in the illustrated embodiment. Both the fixed detents 116 and the angled detents 118 are configured to engage with corresponding positioning detents 92 on the push section 78 of the door 76. In particular, the positioning detents 92 slide over and then engage the underside 122, 124 of either the fixed detent 116 or the angled detent 118 and, due to the upward bias provided by the hinge 84, holds the door 76 securely but releasably in place. The detent structure 114 can be used to keep the door in a closed position or an open position in which the door is opened a predetermined degree.

Figure 5:
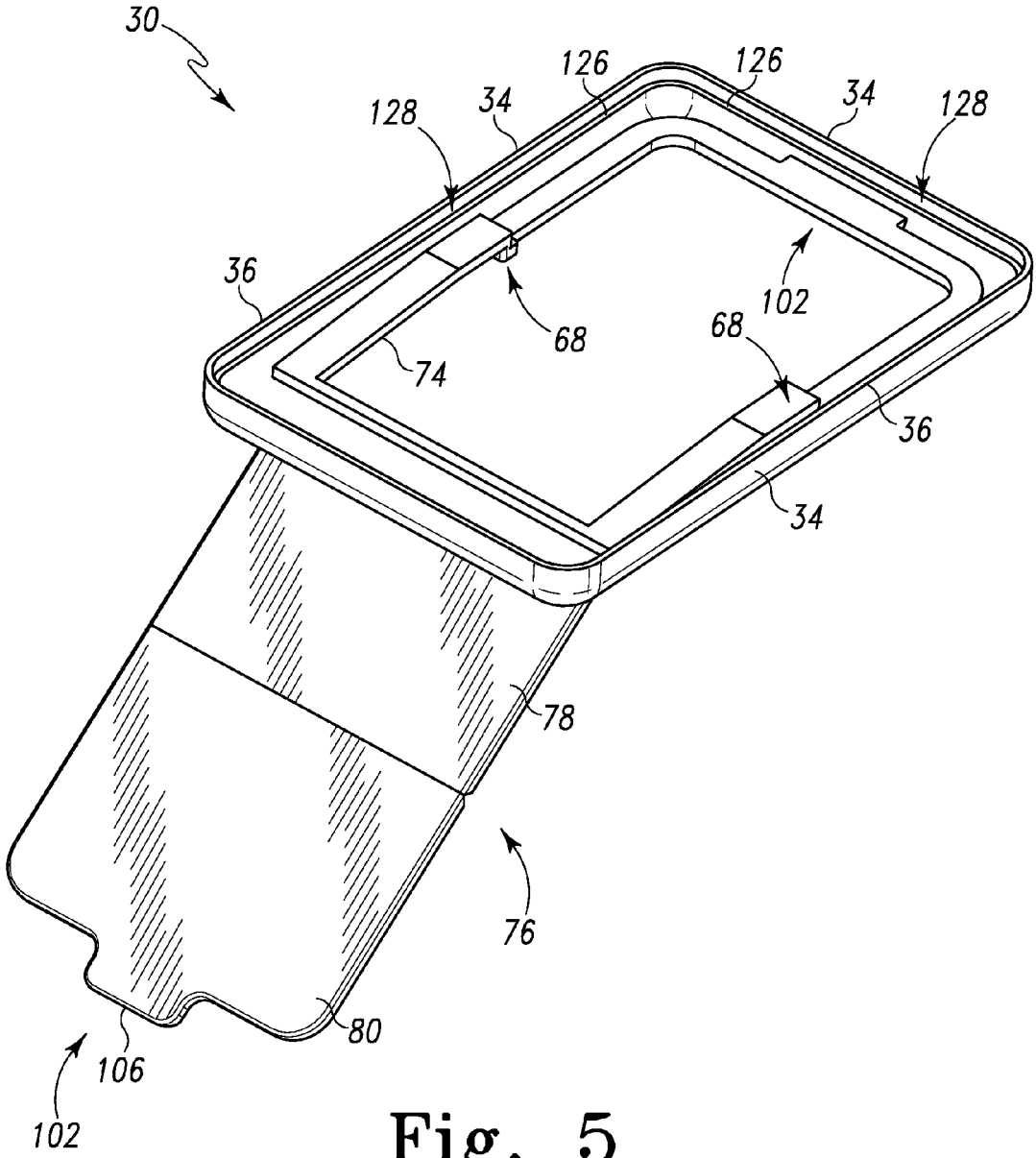
FIG. 5 is a bottom and back perspective view of a lid body of the container of FIG. 1.
Figure 6:
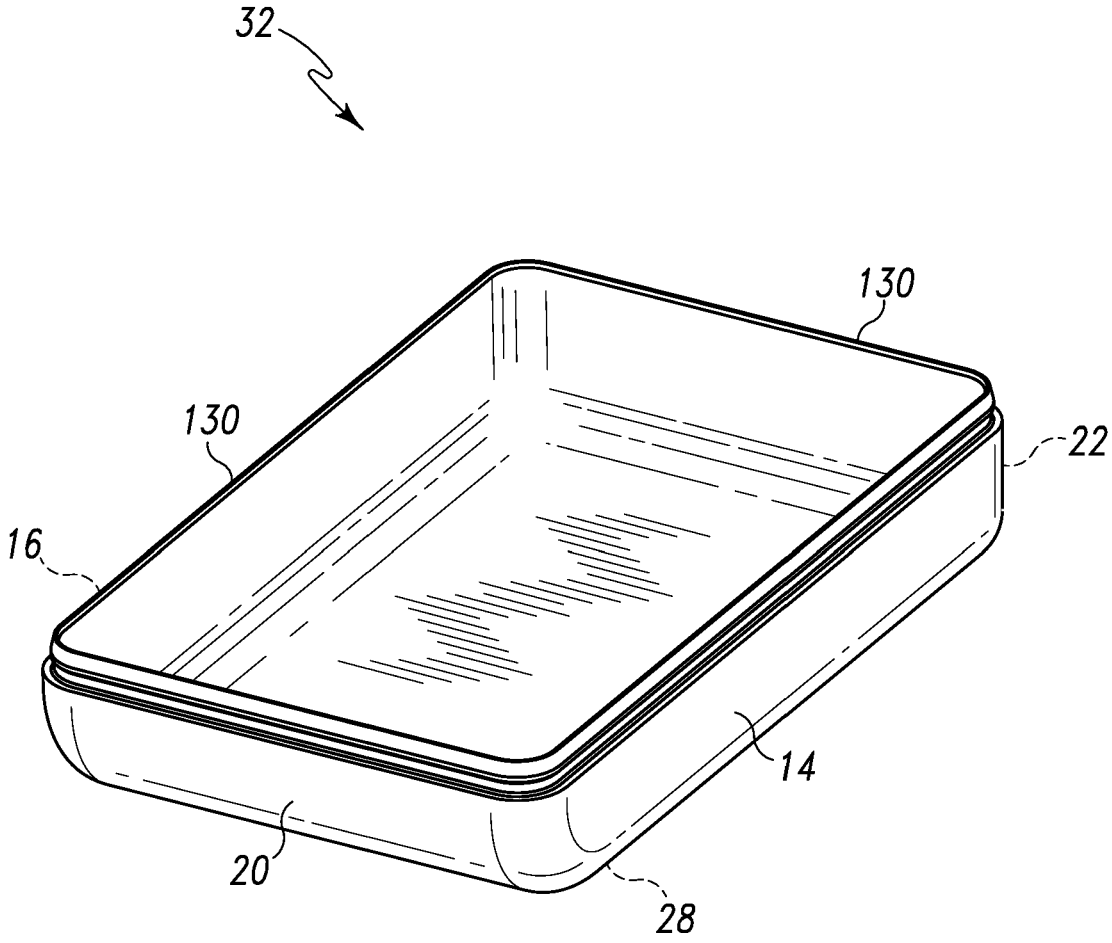
FIG. 6 is a top and front perspective view of a container base of the container of FIG. 1.

When the lid 30 has been removed from the container 32 and flipped over from the orientation in FIG. 1, the lid body reveals an internal flange 126 running inside, parallel to, and spaced apart from the skirt 34 to form an upwardly-extending channel 128 as shown in FIG. 5. The channel 128 is configured to receive an upwardly-directed flange 130 or similar structure formed on the container 32 shown in FIG. 6.

When the lid 30 is oriented over and pressed downwardly upon the container 32, the flange 130 is received in the channel 128 to releasable secure the lid 30 to the container 32 through a friction fit. Upon application of enough force to counter the friction fit, the flange 130 is pulled free of the channel 128 to disengage the lid 30 from the container 32. When the lid 30 is separate from the container 32, the entire contents of the containment vessel 10 held in the inner storage area 40 are accessible.

In operation, and referring back to FIG. 1, the containment vessel 10 begins in a closed position. While in the closed position, the dispensing opening 38 is completely covered by the door 76. In addition, the positioning detents 92 on the flip section 80 are situated below and engaged with the fixed detents 116 on the detent structure 114, the catch 104 is biased against the front shelf 42, and the tab 106 is seated within the tab channel 50.

When a downward pressure (i.e., a pressure toward the container 32) is applied to the push section 78, the push section begins to move toward the rear shelves 54. The positioning detents 92 disengage from the 122 of the fixed detents 116 and begin moving toward the angled detents 118. The portion of the flip section 80 proximate the hinge 100 engages the pivot walls 70, 72 causing the flip section to pivot relative to the push section 78 and to move upwardly and away from the dispensing opening 38. Also, the tab 106 begins to pull free of the tab channel 50 as the flip section rises.

Figure 7:
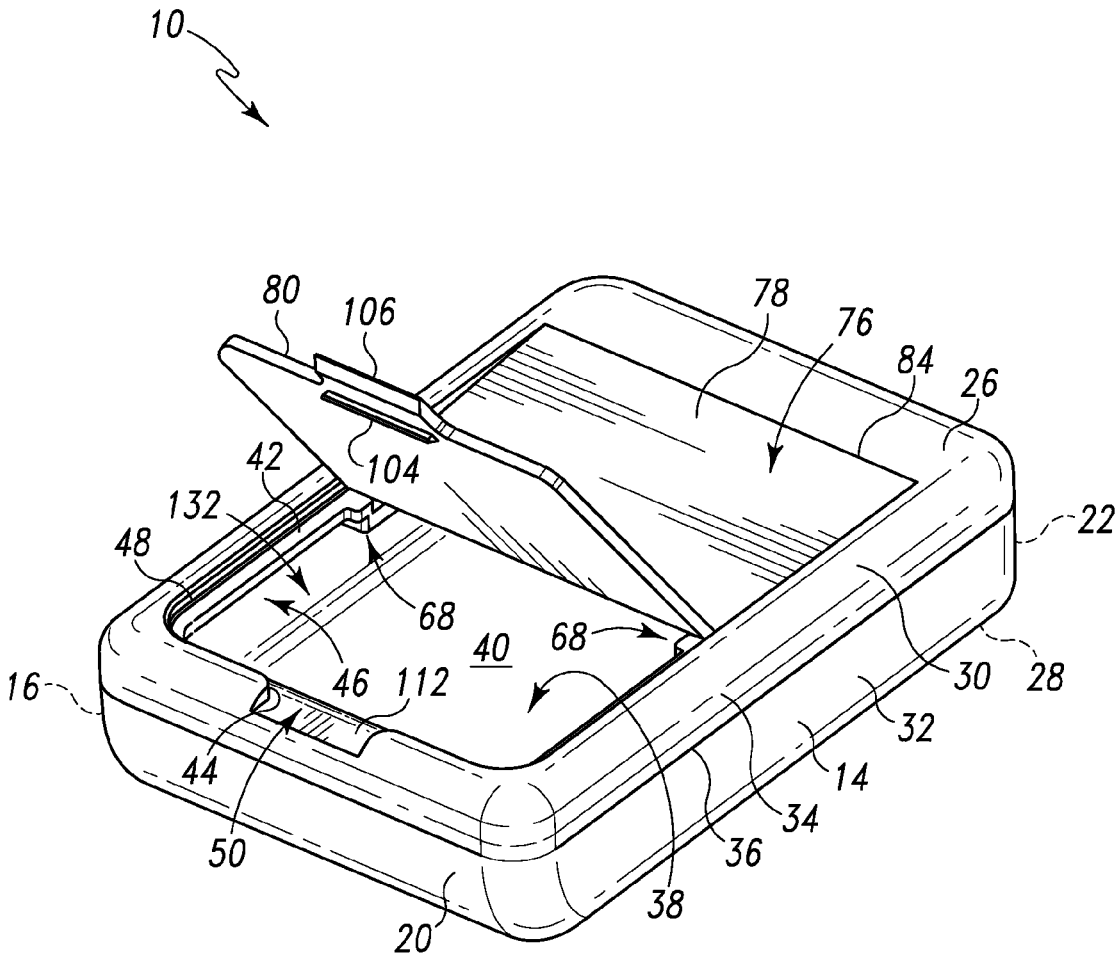
FIG. 7 is a front and top perspective view of the container of FIG. 1 in a flipped opened position.

After a sufficient amount of downward pressure has been exerted upon the push section 78, the container assumes an open position as shown in FIG. 7. In the open position, the positioning detents 92 have slid past the angled detents 118 such that the positioning detent is engaged with the underside 124 of the angled detents 118.

During the transition of the containment vessel 10 away from the closed position, the rear shelves 54 act as a stop to prevent the push section 78 from passing through dispensing opening 38. In addition, the stabilizing ribs 88 on the push section 78 enter into and engage with the stabilizing grooves 66 on the rear shelves 54, which also provide structure that may be used to prevent the push section 78 from passing through the dispensing opening 38. In this regard, the stabilizing ribs 88 and stabilizing grooves 66 generally help to align the door 76 relative to the lid 30. Also, when engaged with each other the stabilizing ribs 88 and stabilizing grooves 66 generally structurally support the door 76. In particular, the stabilizing ribs 88 anchor the door 76 to the lid 30 to prevent, for example, the door 76 from bowing too far down into the inner storage area 40 if too great an amount of downward force is exerted upon the push section 78.

In the open position, the portion of the flip section 80 proximate the hinge 100 remains engaged with the pivot walls 70, 72, which have now biased the flip section 80 upwardly until approximately transverse to the push section 78. In this open position, a forward portion 132 of the dispensing opening 38 is revealed. As such, any contents within the inner storage area 40 of the containment vessel 10 are dispensed by turning the container over, tipping the container, shaking the container, or some combination thereof.

From the open position shown in FIG. 7, the containment vessel 10 can be reverted back to the closed position of FIG. 1. To effectuate this transition, a forward force (toward the front 20 of the containment vessel 10 and/or the tab channel 50) is exerted on the flip section 80. When a sufficient amount of force is supplied, the positioning detents 92 disengage from the underside 124 of the angled detents 118 and move back into engagement with the underside 122 of the fixed detents 116. Simultaneously, the flip section 80 pivots closer to the dispensing opening 38 until the tab 106 is seated in the tab channel 50 and the catch 104 is once again biased against the front shelf 42. In addition, the push section 78 pivots upon the pivot walls 70, 72 and relative to the flip section 80 until the push section rises from within the lid 30 and becomes coplanar with the flip section and the lid body as shown in FIG. 1.

Also from the open position shown in FIG. 7, the containment vessel 10 can be transitioned into a fully open position as shown in FIG. 2. To accomplish this, an upward force (away from the container 32) is exerted upon the tab 106 of the flip section 80 until the positioning detents 92 have slid past each of the angled and fixed detents 116, 118 on the detent structure 114. After a sufficient amount of force is applied, the entire door 76 is able to pivot about hinge 84 to expose the rearward portion 134 of the dispensing opening 38. Because both the forward and rearward portions 132, 134 of the dispensing opening 38 are now revealed, a greater amount of the contents within the inner storage area 40 of the containment vessel 10 are accessible compared to when the container is in the open position depicted in FIG. 7.

From the fully open position of FIG. 2, the containment vessel 10 can be reverted back to the closed position of FIG. 1. Again, a forward force (toward the front 20 of the containment vessel 10 and/or the tab channel 50) is again exerted on the flip section 80. When a sufficient amount of force is supplied, the positioning detents 92 engage with the fixed detents 116. At about the same time, the flip section 80 pivots closer to the dispensing opening 38 until the tab 106 is seated in the tab channel 50 and the catch 104 is once again biased against the front shelf 42. As before, the push section 78 and the flip section 80 become generally coplanar with the lid 30 as shown in FIG. 1.

From the foregoing, those skilled in the art will recognize that a containment vessel 10 that has a large storage space, yet is made from less material, is described. The containment vessel 10 is easily held within a hand and manipulated into one of several discrete positions to either hold or dispense contents.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A lid, comprising;

a lid body having a top and a skirt, the skirt depending downwardly from the top and extending around a periphery of the top;

an opening formed through the lid body;

a door arranged over the opening and connected to the lid body, the door having a push section and a flip section connected by a hinge;

first and second pivot supports on the lid body separated by the opening, the opening extending between the first and second pivot supports and engaging the door at first and second discrete locations, respectively, such that the flip section pivots about the hinge in response to downward pressure applied to the push section to uncover the opening;

wherein the lid body includes shelving on opposing sides of the opening including a pair of front shelf sections, a pair of rear shelf sections, and a pair of wall sections joining the front shelf sections to the rear shelf sections, respectively, the wall sections extending vertically downward from the front shelf sections to the rear shelf sections to form the first and second pivot supports; and wherein each of the shelves includes a stabilizing groove and the push section includes stabilizing ribs, the stabilizing ribs received in the stabilizing grooves upon the application of the downward pressure on the push section.

2. A lid for a container comprising:

a lid body having an aperture passing therethrough;

a front shelf extending inwardly into the aperture, the front shelf progressing along a front wall and a front portion of side walls of the lid body;

rear shelves extending inwardly into the aperture, the rear shelves progressing along a rear portion of the side walls of the lid body;

first and second pivot walls separated by the aperture and coupling the front shelf to the rear shelves, the pivot walls extending inwardly into the aperture and generally transverse to the front shelf;

a door pivotally coupled to the lid body proximate the rear shelves, the door having a push section pivotally connected to a flip section, the flip section engaging the first and second pivot walls and pivoting away from the aperture in response to a downward pressure on the push section;

detent structures formed on the lid body proximate the pivot walls and the rear shelves, the detent structures holding the push section at a first position when the flip section covers a forward portion of the aperture and at a second position when the flip section is pivoted away from the forward portion of the aperture due to application of the downward pressure; and wherein each of the rear shelves include a stabilizing groove and the push section includes stabilizing ribs, the stabilizing ribs received in the stabilizing grooves upon the application of the downward pressure on the push section.

3. A lid for a container comprising:

a lid body having an aperture passing therethrough;

a front shelf extending inwardly into the aperture, the front shelf progressing along a front wall and a front portion of side walls of the lid body;

rear shelves extending inwardly into the aperture, the rear shelves progressing along a rear portion of the side walls of the lid body;

first and second pivot walls separated by the aperture and coupling the front shelf to the rear shelves, the pivot walls extending inwardly into the aperture and generally transverse to the front shelf;

a door pivotally coupled to the lid body proximate the rear shelves, the door having a push section pivotally connected to a flip section, the flip section engaging the first and second pivot walls and pivoting away from the aperture in response to a downward pressure on the push section;

detent structures formed on the lid body proximate the pivot walls and the rear shelves, the detent structures holding the push section at a first position when the flip section covers a forward portion of the aperture and at a second position when the flip section is pivoted away from the forward portion of the aperture due to application of the downward pressure; and wherein each of the rear shelves has a flat portion and an sloped portion, the flat portion disposed proximate the pivot walls and the detent structure.

4. A lid for a container comprising:

a lid body having an aperture passing therethrough;

a front shelf extending inwardly into the aperture, the front shelf progressing along a front wall and a front portion of side walls of the lid body;

rear shelves extending inwardly into the aperture, the rear shelves progressing along a rear portion of the side walls of the lid body;

first and second pivot walls separated by the aperture and coupling the front shelf to the rear shelves, the pivot walls extending inwardly into the aperture and generally transverse to the front shelf;

a door pivotally coupled to the lid body proximate the rear shelves, the door having a push section pivotally connected to a flip section, the flip section engaging the first and second pivot walls and pivoting away from the aperture in response to a downward pressure on the push section;

detent structures formed on the lid body proximate the pivot walls and the rear shelves, the detent structures holding the push section at a first position when the flip section covers a forward portion of the aperture and at a second position when the flip section is pivoted away from the forward portion of the aperture due to application of the downward pressure; and wherein each of the detent structures includes a fixed detent and an angled detent, the fixed detents engaging the positioning detents when the flip section covers the forward recess portion and engaging the angled detents when the flip section is pivoted away from the forward recess portion.

5. A lid, comprising:

a lid body having a top and a skirt, the skirt depending downwardly from the top and extending around a periphery of the top;

an opening formed through the lid body;

a door arranged over the opening and connected to the lid body, the door having a push section and a flip section connected by a hinge;

first and second pivot supports on the lid body separated by the opening, the opening extending between the first and second pivot supports and engaging the door at first and second discrete locations, respectively, such that the flip section pivots about the hinge in response to downward pressure applied to the push section to uncover the opening; and wherein the door has an open position and a closed position relative to the lid body, the opening uncovered in the open position, the first and second pivot supports engaging the flip section and maintaining contact therewith in the open position, and wherein detent means extending from the lid body engage the push section and maintain contact therewith in the open position.

6. A containment vessel comprising:

a body defining a base, a top and a sidewall extending transversely between the base and top to define an enclosed space;

an opening formed through the body providing access to the enclosed space;

a door attached to the body and covering the opening, the door having a push section and a flip section connected by a hinge;

first and second pivot supports on the body in lateral spaced relation, the first and second pivot supports engaging the door at first and second discrete locations, respectively, such that the flip section pivots about the hinge in response to downward pressure applied to the push section to uncover the opening;

wherein the enclosed space extends between the first and second supports such that the enclosed space is in direct communication with both the push and flip sections of the door through the opening; and wherein the door has an open position and a closed position relative to the body, the opening uncovered in the open position, the first and second pivot supports engaging the flip section and maintaining contact therewith in the open position, and wherein detent means extending from the body engage the push section and maintain contact therewith in the open position.

7. A lid for a container comprising:

a lid body having an aperture passing therethrough;

a front shelf extending inwardly into the aperture, the front shelf progressing along a front wall and a front portion of side walls of the lid body;

rear shelves extending inwardly into the aperture, the rear shelves progressing along a rear portion of the side walls of the lid body;

first and second pivot walls separated by the aperture and coupling the front shelf to the rear shelves, the pivot walls extending inwardly into the aperture and generally transverse to the front shelf;

a door pivotally coupled to the lid body proximate the rear shelves, the door having a push section pivotally connected to a flip section, the flip section engaging the first and second pivot walls and pivoting away from the aperture in response to a downward pressure on the push section;

detent structures formed on the lid body proximate the pivot walls and the rear shelves, the detent structures holding the push section at a first position when the flip section covers a forward portion of the aperture and at a second position when the flip section is pivoted away from the forward portion of the aperture due to application of the downward pressure; and wherein the door has an open position and a closed position relative to the lid body, the aperture uncovered in the open position, the first and second pivot walls engaging the flip section and maintaining contact therewith in the open position, and wherein the detent structures engage the push section and maintain contact therewith in the open position.

* * * * *

UNITED STATES PATENT AND TRADEMARK OFFICE

CERTIFICATE OF CORRECTION

PATENT NO. : 7,954,664 B2
APPLICATION NO. : 11/762469
DATED : June 7, 2011
INVENTOR(S) : Edward P. Cronin et al.

It is certified that error appears in the above-identified patent and that said Letters Patent is hereby corrected as shown below:

Claim 1,
Line 53, after "comprising" replace the ";" with a ":".

Signed and Sealed this
Twenty-sixth Day of July, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,954,664 B2
APPLICATION NO. : 11/762469
DATED : June 7, 2011
INVENTOR(S) : Edward P. Cronin et al.

It is certified that error appears in the above-identified patent and that said Letters Patent is hereby corrected as shown below:

Column 8, line 53 (Claim 1, line 1) after "comprising" replace the ";" with a ":".

This certificate supersedes the Certificate of Correction issued July 26, 2011.

Signed and Sealed this
Twenty-third Day of August, 2011

David J. Kappos

David J. Kappos
*Director of the United States Patent and Trademark Office*